United States Patent [19]

Klawiter

[11] Patent Number: 5,069,264

[45] Date of Patent: Dec. 3, 1991

[54] HOLD-DOWN BRACKET FOR BOTTOM RAIL OF A WINDOW COVERING

[75] Inventor: James A. Klawiter, Madison, Wis.

[73] Assignee: Graber Industries, Inc., Middleton, Wis.

[21] Appl. No.: 656,868

[22] Filed: Feb. 19, 1991

[51] Int. Cl.[5] ..... E06B 9/30

[52] U.S. Cl. ..... 160/178.1; 160/349.1

[58] Field of Search ..... 160/178.1, 349.1; 24/702, 684; 248/294

[56] References Cited

U.S. PATENT DOCUMENTS

| | | | |
|---|---|---|---|
| 1,836,018 | 12/1931 | Dover | 248/294 |
| 2,402,769 | 6/1946 | Nelson . | |
| 2,684,226 | 7/1954 | Sundell et al. | 248/294 |
| 3,447,586 | 6/1969 | Anderle . | |
| 4,607,816 | 8/1986 | Haines | 248/201 X |

*Primary Examiner*—Blair M. Johnson

*Attorney, Agent, or Firm*—Vernon J. Pillote

[57] ABSTRACT

A hold-down bracket for the bottom rail of a door or window covering. The hold-down bracket comprised a generally L-shaped bracket member having a mounting flange adapted to be attached either upright or horizontal support surface and a leg extending transverse of the mounting flange. A bracket extension is mounted on the leg for angular adjustment about an axis perpendicular to the leg and spaced from the mounting flange and a bottom rail connector pin is provided on the bracket extension at a location spaced from the axis. Detents are provided to releasably retain the bracket extension at least two different angularly adjusted positions relative to the leg, to change the spacing between the bottom rail connector pin and the mounting flange.

10 Claims, 1 Drawing Sheet

FIG. 1.
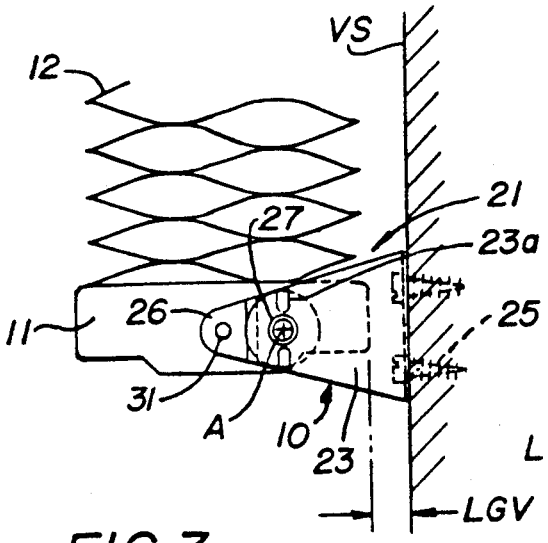
FIG. 2.
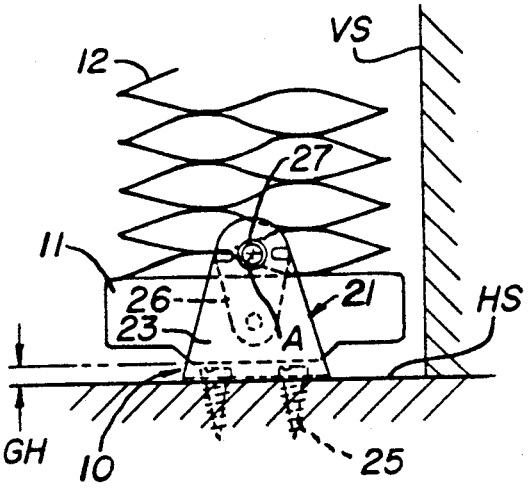
FIG. 3.
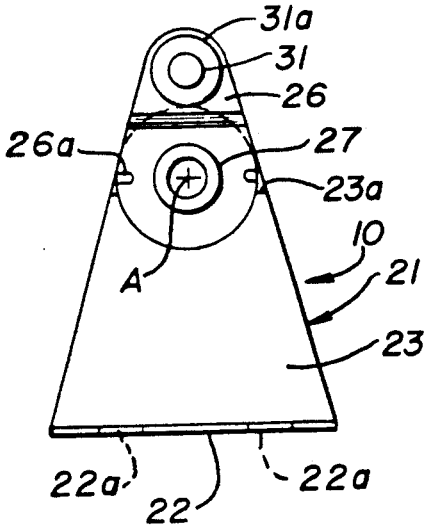
FIG. 4.
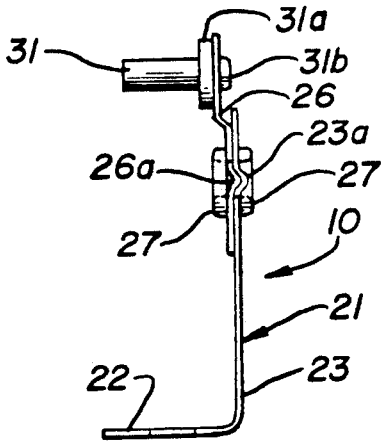
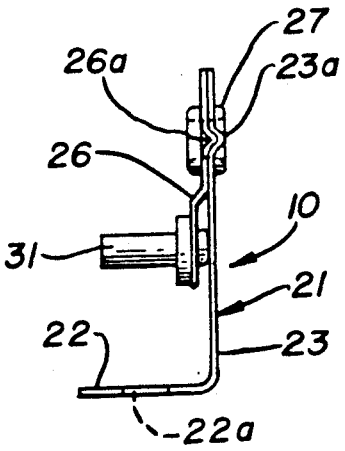
FIG. 5.

HOLD-DOWN BRACKET FOR BOTTOM RAIL OF A WINDOW COVERING

BACKGROUND OF THE INVENTION

Hold-down brackets are used to support the bottom rail of a door or window covering such as the venetian blind or foldable shade, to prevent the window covering from swinging. The hold-down brackets are used at both ends of the bottom rail and is accordingly desirable that the same hold-down bracket be useable as either a left or a right end bracket. In addition the hold-down brackets are sometimes mounted on a horizontal surface such as a window sill, and at other times are mounted on vertical surface such as an upright wall or on the face of a door.

Some prior hold-down brackets such as disclosed in U.S. Pat. Nos. 2,402,769 and 3,447,586, are adapted to be used on either the left or right ends of the bottom rail and are also adapted to support the bottom rail when the hold-down bracket is mounted on either a horizontal or an upright surface. However, the width of the bottom rail of the shade is usually much greater than the depth of the bottom rail and, when the hold-down brackets of the above patents are dimenisioned to pivotly support the hold-down rail at its longitudinal axis when the hold-down bracket is mounted on an upright surface, then the bottom rail will be spaced a substantial distance above the sill, when the hold-down bracket is mountead on a horzontal surface, and produce an undesirable light gap. Conversely, if the brackets of the above patents are dimensioned to minimize the gap between the bottom rail and a sill, when the hold-down bracket is mounted on a sill, then problems may be encountered in providing adequate clearance between the side edge of the bottom rail and an upright surface, when the hold-down bracket is mounted on an upright surface

SUMMARY OF THE INVENTION

It is an object of the present invention to provide a hold-down bracket for the bottom rail of a blind or shade which can be mounted on either a horizontal surface or an upright surface and which will minimize the light gap between the underside of the bottom rail when the bracket is mounted on a horizontal surface and which will provide a minimal light gap between the edge of the bottom rail and an upright surface, when the bracket is mounted on a upright surface.

Another object of this invention is to provide a hold-down bracket for a blind or shade in accordance with the foregoing object, and which can be used on either the left or the right ends of the bottom rail.

Accordingly, the present invention provides a hold-down bracket for the bottom rail of a door or window covering including a bracket member having a mounting flange adapted to be attached to either a horizontal or an upright surface and a leg extending transverse the mounting flange. A bracket extension is mounted on a leg for angular adjustment about an extension pivot axis perpendicular to the leg and spaced a first distance from the mounting flange, and bottom rail connector means are on the bracket extension at a location spaced from the pivot axis a distance less than the first distance. Detent means are provided for releasably retaining the bracket extension in at least two different angularly adjusted positions relative to the leg to change the spacing between the bottom rail connector means and the mounting flange.

The bottom rail connector means preferably comprises a pivot pin fixed to the bracket extension and extending parallel to the pivot axis and adapted for reception in an opening in the end of the bottom rail. The detent means is arranged to support the bracket extension in one position which the pivot pin is located intermediate the pivot axis and the mounting flange, to decrease the spacing between the bottom rail and the window sill, when the mounting flange is mounted on the sill, and at least one other position in which the pivot pin is spaced outwardly from the pivot axis to increase the spacing between the pivot pin and mounting flange, when the bracket is mounted on an upright surface.

BRIEF DESPRIPTION OF THE DRAWINGS

FIG. 1 is a fragmentary vertical sectional view illustrating a hold-down bracket mounted on a vertical surface for supporting the bottom rail of a window covering;

FIG. 2 is a fragmentary vertical sectional view illustrating the hold-down bracket mounted on a horizontal surface for supporting the bottom rail of a window covering;

FIG. 3 is a side view of the hold-down bracket on a larger scale than FIG. 1, showing the bracket extension in an extended position;

FIG. 4 is an edge view of the hold-down bracket of FIG. 3; and

FIG. 5 is an edge view of the hold-down bracket with the bracket extension in a folded condition.

DETAILED DESPRIPTION

The hold-down bracket 10 is adapted to support the bottom rail 11 of a window covering 12 such as a venetian blind or collapsible shade diagrammatically indicated at 12 FIGS. 1 and 2. The bottom rail 11 of such window coverings commonly have a width, measured between opposite side edges and perpendicular to the expanse of the window covering, that is substantially greater than the depth measured parallel to the expanse of the window covering. The hold-down bracket 10 is adapted for mounting on either an upright surface designated VS in FIG. 1 or on a horizontal surface designated HS at FIG. 2, and to support the bottom rail in a manner to provide a minimal light gap between the bottom rail and the surface to which the hold-down bracket is mounted. Thus, as shown in FIG. 1, the bracket is arranged to provide a relatively small light gap designated LGV between a side edge of the bottom rail and the vertical surface VS to which the bracket is mounted. As shown in FIG. 2, the hold-down bracket is arranged to provide a minimal light gap designated LGH between the underside of the bottom rail and the horizontal surface designated HS.

The hold-down bracket includes a bracket member 21 having a mounting flange 22 and a leg 23 extending transverse to the flange. The bracket 21 is preferably formed of sheet metal bent into an L-shaped configuration with fastener receiving openings 22*a* in the mounting flange for receiving fasteners such as screws 25 or the like. A bracket extension 26, also preferably formed from spring type steel, is provided and mounted on the leg 23 for angular adjustment relative thereto about an axis A that is perpendicular to the leg and parallel to the flange 22. The bracket extension is disposed at the inner side of leg 23 an is conveniently mounted by a rivet 27 on the leg 23. and means are provided for releasably retaining the bracket extension in at least two different anglarly adjusted positions relative to the leg 23. In the embodiment shown, this means includes interengaging detents 23*a*, 26*a* on the leg 23 and bracket extension 26 respectively.

Bottom rail connector means are provided for connecting the bracket extension to the bottom rail at a location spaced from the axis A. In the preferred embodiment, the bottom rail connector means comprises a pin 31 that is mounted on the bracket extension at a location spaced from the pivot axis A and arranged to extend parallel to the pivot axis and to the flange 22. The pin may, for example, be provided with a shoulder 31*a* intermediate its ends with an end portion 31*b* FIG. 4, that extends through an opening (not shown) in the bracket extension, and which end portion is staked or riveted over to hold the pin on the bracket extension. The pin is adapted for reception in an opening or socket (not shown) in the end of the bottom rail, which opening is preferably located along the center-line of the bottom rail. Alternatively, the pin 31 could be fixed to the end of the bottom rail and extend into an opening or socket in the bracket extension. As best shown in FIGS. 4 and 5, the bracket extension has an offset to provide clearance for the end 31*b* of the pin, when then the bracket extension is the folded position shown in FIG. 5.

The detent means 23*a*, 26*a* is arranged to releasably retain the bracket extension in at least two different angularly adjusted positions to the leg 23, to change the spacing between the bottom rail connector pin 27 and the mounting flange. More particularly, the bracket extension is adjustable to one position as shown in FIG. 1 in which the bottom rail connector pin 27 is spaced outwardly from the pivot axis A, to increase the spacing between the bottom rail connector pin and the flange for use when the hold-down bracket is mounted on a vertical surface designated VS in FIG. 1. The bracket extension is also movable to a second position in which the bottom rail connector pin 27 is located intermediate the axis A on the flange 22, to reduce the spacing between the bottom rail connector pin and the flange in installations where the hold-down bracket is mounted on a horizontal surface as shown in FIG. 2. The extended and folded positions shown in FIGS. 1 and 2 are preferably 180 degrees apart and the detents 23*a*, 26*a* are arranged to extend generally radially from the pivot axis A. The hold-down bracket is arranged to provide only a small light gap between the bottom rail and either a vertical or horizontal mounting surface. For example, the hold-down bracket and the end of the bottom rail are shown full scale in FIGS. 1 and 2. One side edge of the bottom rail is spaced about 2 cm from the pivot pin 27 and the bottom of the bottom rail is spaced about 0.6 cm from the pin 27. Axis A is spaced about 1.7 cm from the outer face of the mounting flange 22 and pin 31 is spaced about 0.8 cm from axis A. With this arrangement, the light gap LGH when the bracket is mounted on a vertical surface is about 0.5 cm and the light gap LGH when the bracket is mounted on a horizontal surface is about 0.2 cm.

The embodiments of the invention in which an exclusive property or privilege is claimed are defined as follows:

1. In combination with a door or window covering including an elongated bottom rail, a hold-down bracket for the bottom rail comprising, a bracket member having a mounting flange adapted to be attached to a support surface and leg extending transverse to the mounting flange, a bracket extension, means mounting the bracket extension on the leg for angular adjustment relative thereto about a first axis perpendicular to the leg and spaced a first distance from the mounting flange, bottom rail connector means for connecting an end of the bottom rail to the bracket extension at a location spaced from the first axis a second distance less than said first distance, the bottom rail connector means supporting the bottom rail for pivotal movement about a second axis extending lengthwise of the bottom rail and parallel to the first axis, said means for mounting the bracket extension including means for releasably retaining the bracket extension in at least two different angularly adjusted positions relative to the leg to change the spacing between the bottom rail connector means and the mounting flange.

2. The combination of claim 1 wherein said means for releasably retaining the bracket extension comprises detent means constructed and arranged to releasably retain the bracket extension in one position in which the bottom rail connector means is spaced from the mounting flange a distance greater than said first distance and another position in which the bottom rail connector means is spaced from the mounting flange a distance less than said first distance.

3. The combination of claim 1 wherein the bottom rail connector means comprises a pin on the bracket extension disposed parallel to the first axis and spaced therefrom a distance less than said first distance.

4. A hold-down bracket for the bottom rail of a door or window covering comprising, a generally L-shaped sheet metal bracket member having a mounting flange and a bracket plate extending transverse to the mounting flange, a sheet metal bracket extension, means mounting a bracket extension on the bracket plate for angular adjustment about an axis perpendicular to the bracket plate and spaced a first distance from the mounting flange, bottom rail connector means on the bracket extension at a location spaced from the axis a distance less than said first distance, said means for mounting the bracket extension including means for releasably retaining the bracket extension in at least two angularly adjusted positions relative to the bracket plate to change the spacing between the bottom rail connector means and the flange portion of the bracket member.

5. A hold-down bracket according to claim 4 wherein said bottom rail connector means comprises a pivot pin on the bracket extension disposed parallel to the axis and spaced therefrom a second distance less than said first distance.

6. A hold-down bracket according to claim 4 wherein the means for releasably retaining the bracket extension includes detent means constructed and arranged to releasably retain the bracket extension in one position in which the bottom rail connector means is spaced from the mounting flange a distance less than said first distance and another position in which the bottom rail connector means is spaced from the mounting flange a distance greater than said first distance.

7. A hold-down bracket according to claim 4 wherein the bottom rail connector means comprises a pin on the bracket extension disposed parallel to the pivot axis and spaced therefrom a second distance less than said first distance, the means for releasably retaining the bracket extension including detent means constructed and arranged to releasably retain the bracket extension in a first position in which the pin is disposed intermediate the mounting flange and the axis and a second position in which the pin is disposed outwardly of the axis.

8. A hold-down bracket according to claim 7 wherein the pin is disposed in a plane parallel to the axis and to the flange when the pin is in said first and second positions.

9. In combination with a door or window covering including a bottom rail, the bottom rail having a width measured perpendicular to the expanse of the covering that is substantially greater than the depth measured parallel to the expanse of the window coverings, comprising, a generally L-shaped sheet metal bracket member having a mounting flange and a bracket plate extending transverse to the mounting flange, a sheet metal bracket extension, means mounting the bracket extension on the bracket plate for angular adjustment about an axis perpendicular to the bracket plate and spaced a first distance from the mounting flange, bottom rail connector means on the bracket extension at a location spaced from the axis a distance less than said first distance, said means mounting the bracket extension including means for releasably retaining the bracket extension in at least two angularly adjusted positions relative to the bracket plate to change the spacing between the bottom rail connector means and the flange portion of the bracket member.

10. The combination of claim 9 wherein the bottom rail connector means includes a pin receiving opening in an end of the bottom rail and pin on the bracket extension disposed parallel to the axis and spaced therefrom a second distance less than said first distance.

* * * * *